US006026661A

United States Patent [19]

Spiropoulos

[11] Patent Number: 6,026,661

[45] Date of Patent: Feb. 22, 2000

[54] RESTRAINING DEVICE AND METHOD OF USING

[76] Inventor: Christos T. Spiropoulos, 2517 W. Highland St., Allentown, Pa. 18104-3637

[21] Appl. No.: 09/239,041

[22] Filed: Jan. 27, 1999

[51] Int. Cl.[7] ..... E05B 75/00

[52] U.S. Cl. ..... 70/16; 70/17; 242/388; 242/388.6

[58] Field of Search ..... 70/15–18; 242/388.8, 242/388, 388.6; 119/794, 796

[56] References Cited

U.S. PATENT DOCUMENTS

| | | | |
|---|---|---|---|
| 204,669 | 6/1878 | Hickox | 70/16 |
| 787,430 | 4/1905 | Bonnel et al. | 70/16 |
| 887,072 | 5/1908 | Delaney | 719/796 |
| 1,534,936 | 4/1925 | Fischbach . | |
| 2,601,409 | 6/1952 | McArthur et al. | 242/388.8 |
| 2,743,068 | 4/1956 | Walke | 242/388.8 |
| 3,426,559 | 2/1969 | Schubach et al. | 70/16 |
| 4,024,736 | 5/1977 | De Michteli | 70/16 |
| 4,909,051 | 3/1990 | Lee . | |
| 4,964,370 | 10/1990 | Peterson | 119/109 |
| 5,212,875 | 5/1993 | Corso | 242/388.8 |
| 5,345,947 | 9/1994 | Fisher | 70/16 |
| 5,377,626 | 1/1995 | Kilsby et al. | 119/796 |
| 5,443,155 | 8/1995 | Robinson . | |
| 5,581,853 | 12/1996 | Miller et al. | 70/16 |
| 5,651,376 | 7/1997 | Thompson . | |
| 5,768,920 | 6/1998 | De Bevoise | 70/18 |

*Primary Examiner*—Darnell M. Boucher
*Attorney, Agent, or Firm*—Charles A. Wilkinson

[57] ABSTRACT

A pair of restraints, preferably in the form of handcuffs, are separately connected to a housing assembly by way of elongated cables. The cables are attached at their other ends to a rotatable spool sturdily housed within a box ratchet assembly. Each restraint is first separately applied to a resisting arrestee's wrists. The cables are then reeled into the spool member with a ratcheting motion, enabling a law enforcement official to maintain a controlled joinder of the handcuffs and the arrestee's wrists.

17 Claims, 4 Drawing Sheets

RESTRAINING DEVICE AND METHOD OF USING

BACKGROUND OF THE INVENTION

1. Field of the Invention

This invention relates generally to handcuffs or similar-type restraints, and more specifically to an apparatus that enables an arresting officer to separately apply each restraint to each wrist of a resisting arrestee, regardless of the position or location of each wrist, and further allows the arresting officer to bring each restraint together, thereby joining the arrestee's wrists effectively to each other at the same time.

2. Preliminary Discussion

It is often the case that a criminal "takedown", or physical overpowering of a resisting miscreant pursuant to an arrest, will require three, four and sometimes five police officers to effect the application of a set of handcuffs to a single arrestee. Since conventional handcuff bracelets are connected by approximately one inch of chain, arresting officers must effectively join, or bring together, the suspect's arms in order to secure both wrists together prior to the application of such handcuffs.

A resisting arrestee, who is young and strong, can make it virtually impossible for just two officers to properly apply a pair of conventional handcuffs, especially if the officers are not as powerful as the resisting arrestee or just out of shape. As a result, one or more of the arresting officers would have to step up to a higher level of force, i.e. pepper spray or baton, and with every increase in force, there exists the increased potential for injury or liability of the officers and/or injury, and sometimes further liability, of the arrestee.

Even with additional "backup," it seldom, if ever, provides a favorable impression, or "looks good" to see three or more officers on top of a single unarmed arrestee, especially since the nature of the takedown is often hidden from view by the bodies of the arresting officers. Such a scene has often incited uninvolved observers to become sympathetic to the arrestee and even to interfere with the arrest. Of course, the most popular bystander response in today's age of cop shows and helicopter reporting is to try and capture the incident on film, which can make a bad situation look even more incriminating, especially if the officer's application of force is perceived as unjustified in the public eye.

The problem of restraining a resisting arrestee, or restrainee, is especially dangerous in a prison setting, where corrections officers are usually in the minority and must be self-sufficient in a world of aggressively dangerous individuals, many or most of whom have complete contempt for law and authority in general. For example, in a prison setting, corrections officers often experience wild, unanticipated bursts of energy from a restrainee after the application of a single cuff to only one of the restrainee's wrists. This creates an immediate and dangerous situation for the restraining officer, because at this point the handcuffs now become a weapon for the prisoner. It is often the case that as the stimulated prisoner swings with arms flailing wildly at the restraining officers, the unattached restraint, or "bracelets," strikes and splits open noses, cheeks and eyes, resulting in a serious injury or even a potentially fatal situation in the absence of appropriate backup.

It takes an enormous amount of upper body strength to apply standard or conventional handcuffs, especially since the arresting officers must accomplish two difficult feats at once. First, the officer must restrain and immobilize the arrestee. Second, the officer must force the arrestee's arms close enough together so that both wrists can be handcuffed at the same time. Not only do these two actions work against each other, but an arrestee can often use the officer's own strength and force against him. For example, as the officer is forcefully manipulating the arm or arms of an arrestee, it is often the case that an arrestee will suddenly relinquish all resistance and pull away in the same direction that the officer is pushing, thereby allowing the arrestee to break loose from restrainers.

It is no wonder that arresting officers are often winded and justifiably disturbed after such an encounter. In fact, the constant scuffles and dangerous encounters create a highly precarious and unstable environment for arresting officers, and deficiencies in conventional restraining devices tend to make bad situations even worse.

The present inventor, after considerable on-the-job experience with deficient and ineffective restraining devices, has devised an apparatus that overcomes many, if not all, of the deficiencies of conventional handcuffs by enabling an arresting officer to apply a pair of handcuffs in an efficient manner without first expending a great deal of energy in bringing the arrestee's arms together. The apparatus of the present invention streamlines the conventional handcuffing process by allowing an officer to apply each handcuff separately without first having to join the arrestee's arms. Once each handcuff is attached, the apparatus of the present invention enables the arresting officer to forcefully join the arrestee's arms together to assume the conventional handcuffed stance or position. The joinder of the wrist restraints is preferably accomplished through the use of a ratcheting mechanism, similar in design to a fishing reel, to which each restraint is integrally connected. Such mechanism allows the arresting officer to, in effect, "reel in" each restraint until such restraints are brought together in a close relationship. The apparatus of the present invention, therefore, provides a much more effective solution to the problems plaguing conventional handcuff-type devices and creates a safer environment for both the arresting officer and the resisting detainee.

DESCRIPTION OF RELATED ART

The prior art has failed to effectively address the above-stated deficiencies in conventional handcuffs. The evolution of the prior art appears to have focused on the modernization of the handcuff device as a unit, not necessarily on the problems underlying its everyday use. For example, where handcuffs have conventionally been fashioned out of metal, involving complex mechanical structures and key-type release mechanisms, today's handcuffs often comprise disposable, self-locking plastic ties of the type used to bind bundles of wires and the like. Such ties are undoubtedly cheaper to manufacture, and are often useful when the detained individual poses no threat to the safety of the officer, such as may be the case when such individual needs to be temporarily bound during transport to and from the prison or the like. However, simple plastic ties and the like, which are often applied with the cooperation of the detainee, are woefully inadequate in dangerous and risky situations, especially where it is nearly impossible to prepare the detainee's wrist for the proper application of such ties. Some of the prior art references in the handcuff field are described below.

U.S. Pat. No. 1,534,936 issued to E. E. Fischbach on Apr. 21, 1925, entitled "Confining and Restraining Device," discloses the use of separate, yet joinable and lockable, strap devices for the quick restraint of an individual. Finger rings at the ends of a strap accommodate a single finger on the detainor's hands thereby allowing the detainor to grasp, with the remaining fingers, the lockable joining means near the finger rings. The detainor is then required to wrap the strap, by hugging or the like, around the detainee or and quickly bring together the joining means, and after the strap is joined and locked, the detainor pulls outwardly on the finger rings to further tighten the strap. The detainor may then quickly and easily release his or her hands from the finger rings.

U.S. Pat. No. 4,024,736 issued to W. P. DeMichieli on May 24, 1977, entitled "Prisoner Restrainer," discloses a strap rewind reel connected between two ankle cuffs that allows a detainee to walk with a predetermined stride while cuffed. The reel unwinds the strap as the detainee's legs are spread apart, and winds-in the strap as the legs are brought together. A lock inside the wheel activates if the strap unwinds at an excessive rate thereby preventing the detained from assuming a running stride.

U.S. Pat. No. 4,909,051 issued to J. A Lee on Mar. 20, 1990, entitled "Keeper Plate for Strap Handcuffs," discloses a plate which reduces the danger of restricting the detainee's circulation by providing a flattened concave edge that is thicker than the restraining strap.

U.S. Pat. No. 5,099,662 issued to B. Tsai on Mar. 31, 1992, entitled "Contractible Handcuff," discloses an extendible, slotted metal band which automatically encircles and binds any object it touches or contacts, including, but not limited to, a human wrist or an unreachable object. A motor in the handle controls the direction, i.e. extension or retraction, of the metal band, while a hook-like section at the end of the band cooperates with slots in the body of the band to lock and restrain the band around or about an object.

U.S. Pat. No. 5,443,155 issued to E. Robinson on Aug. 22, 1995, entitled "Wrist Restraining Device," discloses a dual system of wrist loops that simultaneously tighten with the pull of a U-shaped bight strap section formed by the positioning of the strap, such bight section also doubling as a handle. The handle section allows the detainor to maneuver the wrist strap assembly while maintaining a safe distance from the detainee's bound, and potentially dangerous, hands.

U.S. Pat. No. 5,651,376 issued to G. Thompson on Jul. 29, 1997, entitled "Flexible Dual Loop Restraining Device" discloses a plastic strap, dual-loop restraint system employing a different tightening orientation or arrangement from those previously mentioned. The Thompson reference stresses the one-way adjustability and simplicity of the structure, noting that not all detainees require the same strap tightness.

The present inventor, after years of personal experience, has determined a need for a restraining system that is more efficient, practical and safer for all individuals involved, as compared with conventional restraining systems of the prior art or currently represented in the marketplace. The prior art is devoid of any references or representations that satisfy those particular, everyday needs addressed by the present inventor and/or his apparatus in accordance with the present invention. It is an undeniable fact that crime will always be a part of our everyday lives. Anything that improves the transition for the criminals and law enforcers during the capture phase, which provides a safer environment for all, should be welcomed with "open arms," and the apparatus of the present invention is, in fact, specifically designed to alleviate the difficulty of capturing or immobilizing those individuals who in fact provide law enforcers with "open arms."

OBJECTS OF THE INVENTION

It is an object of the present invention, therefore, to provide a restraining device that enables law enforcement officials to easily and more efficiently control and handcuff a resisting arrestee.

It is a further object of the present invention to provide a restraining device that enables a resisting arrestee to be apprehended with the least number of law enforcement officials necessary.

It is a still further object of the present invention to provide a restraining device that may be applied to a resisting arrestee regardless of the position of each of the arrestee's appendages, or limbs.

It is a still further object of the present invention to provide a restraining device that, once applied to the arrestee's appendages, or limbs, allows law enforcement officials to join or unite such appendages to a more manageable position.

It is a still further object of the present invention to provide a restraining device that uses a reel and ratchet mechanism to effect the joinder of the handcuffs or manacles of the device of the invention.

It is a still further object of the present invention to provide a restraining device that may be attached or connected to a location adjacent the law enforcement official's body for easy storage, access and implementation.

It is a still further object of the present invention to provide a restraining device that is simple to use and more efficient than conventional handcuff devices.

Still other objects and advantages of the invention will become clear upon review of the following detailed description in conjunction with the appended drawings.

SUMMARY OF THE INVENTION

The apparatus of the present invention comprises a pair of handcuff members, each connected to a housing assembly by way of elongated cable sections. These cable sections are attached at their other ends to a rotatable spool that is sturdily housed within a box ratchet assembly. The elongated cables replace a conventional, short chain piece that normally spans one inch between conventional handcuffs. Such cables are reeled onto the spool member with a ratcheting motion, enabling the law enforcement officer to maintain a controlled joinder of the handcuffs and the arrestee's wrists, while a release mechanism enables a law enforcement official to lengthen the distance between the handcuffs and the housing assembly, thereby lengthening the distance between the separate handcuffs in preparation for their efficient application.

To operate the apparatus of the present invention, each handcuff is separately applied to each of the wrists of the resisting arrestee taking advantage of the increased distance between the handcuff pieces provided by the elongated cable sections. Once the handcuffs are applied, the law enforcement officer or detainer joins the arrestee's wrists by advancing the ratchet mechanism and reeling the handcuff cable sections into the housing assembly. By using the apparatus of the present invention, the officer is not initially required to join the arrestee's wrists, frequently a feat onto itself, prior to applying the handcuffs. This facilitates a reduced law enforcement presence at the crime scene and establishes a safer environment for all persons involved.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
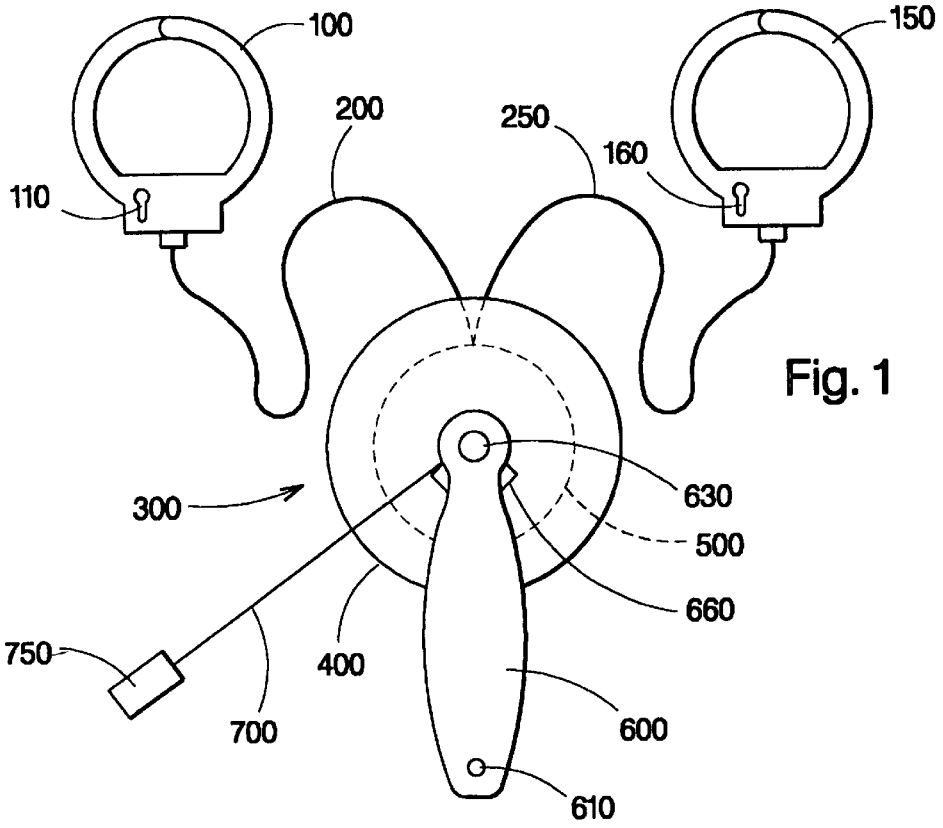
FIG. 1 is an overall, or top view of the restraining device of the present invention.
Figure 2:
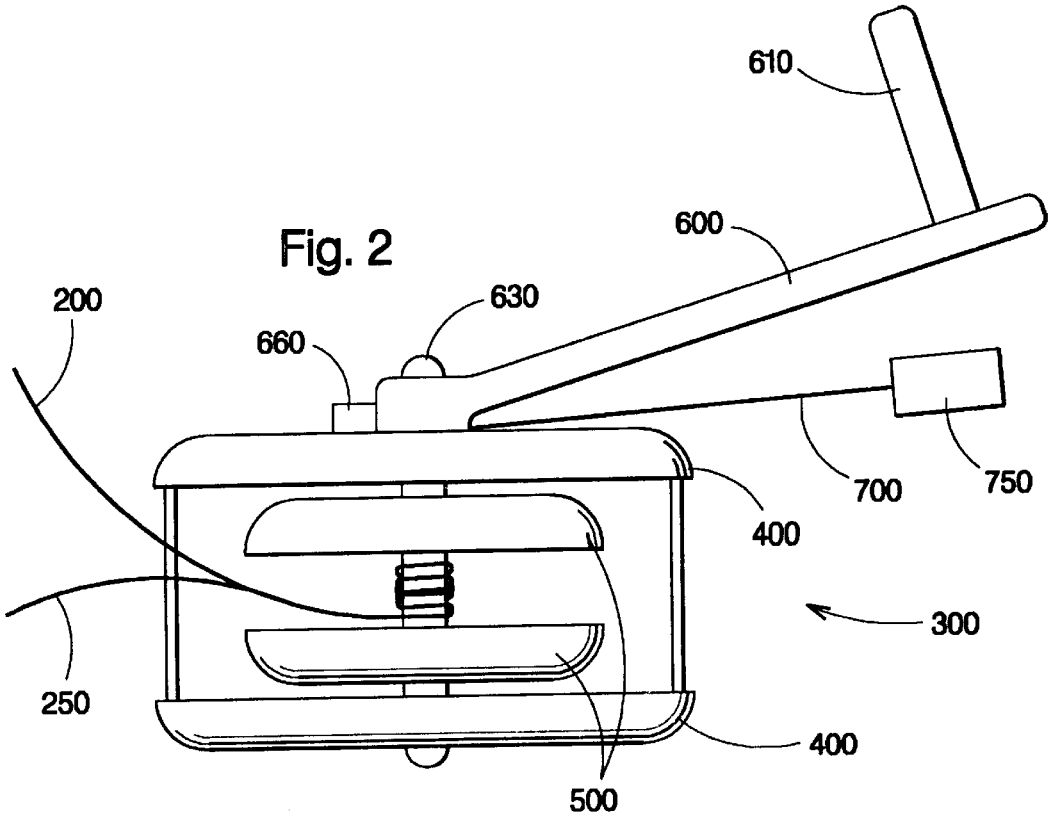
FIG. 2 is an enlarged, side view of the housing assembly of the restraining device of the present invention.

FIG. 1 is an overall, or top view, and FIG. 2 is an enlarged, side view, of the restraining device of the present invention comprising a pair of clasping members or cuffs 100 and 150 (not shown in FIG. 2) each connected to a housing assembly 300 by flexible coupling members or cables 200 and 250 respectively, each cable shown partially in phantom. For purposes of this description, cuffs 100 and 150 will be described as handcuffs for conventional placement about an arrestee's wrists, although the apparatus of the present invention could be applied to other appendages such as an arrestee's ankles or the like. As will be understood, the device of the invention is particularly useful in the case of a resisting arrestee. The housing assembly 300 comprises an outer casing 400, a spool member 500, shown in phantom in FIG. 1 and in full in FIG. 2, a ratchet handle 600 having a ratchet connector 630 and a ratchet release 660. Ratchet handle 600 is preferably of a suitable thickness so that it may be easily and firmly grasped in the palm of a user's hand. The handle 600 may, however, also have a further handle extension 610 for gripping engagement in a vertical plane, shown more clearly in FIG. 2. While such handle extension 610 is optional, it is shown herewith for purposes of illustration. There is also an attachment member 700 connected to the housing assembly 300 having attachment means 750, preferably in the form of a snap, clip or the like, positioned on the end thereof. The attachment member 700 cooperates with an anchoring implement, such anchoring implement shown and described in connection with FIGS. 3 through 6. Cuffs 100 and 150 are shown in FIG. 1 extended away from the housing member 300 with cables 200 and 250 in an outstretched position. Cables 200 and 250 are wound about the spool member 500, or reeled into the housing assembly 300, with the ratcheting handle 600, until the handcuffs 100 and 150 are brought together in close proximity. The elongated cables 200 and 250 allow a user of the apparatus of the present invention, preferably a law enforcement official, to manipulate each handcuff separately and at considerable distance from each other during the apprehension of a resisting arrestee.

The handcuffs 100 and 150 are preferably of the conventional, clasping type having locking means 110 and 160 as shown. The handcuffs 100 and 150 are designed for separate application to each of the arrestee's wrists, without the necessity for pre-joinder of the wrists. The cables 200 and 250 are each preferably approximately two feet long and constructed from steel, for example, one-eighth inch diameter cable. The length, diameter and material composition of the cables 200 and 250 could vary with the circumstances, as long as the length is sufficient to apply the handcuffs 100 and 150 to each wrist of a resisting arrestee respectively even while such wrists are not necessarily conveniently positioned together prior to clasping. The diameter and material composition of the cables should be great enough to withstand even the most unruly resisting arrestee, since it would be hazardous to have the cables snap or break during the act of capture or thereafter. With two-foot cable lengths in their fully outstretched position, the handcuffs of the invention can effectively and efficiently be applied if the resisting arrestee wrists are approximately four feet apart, which is a considerable advantage over conventional handcuffs that are usually separated by a relatively measly one inch chain.

The housing assembly 300, more clearly shown in FIG. 2, comprises a ratchet handle 600 which enables the user or law enforcement official (not shown) to wind or rotate the spool 500 thereby reeling in the cable members 200 and 250 onto the shaft 550, which effectively brings the handcuffs 100 and 150, shown in FIG. 1, closer together. A ratchet mechanism as is generally known to those skilled in the art is built into the handle 600 and connector 630 such that the rotation of the shaft 550 is unidirectional in response to the rotation of the handle 600, with the handle 600 and shaft 550 having the ability to rotate in the opposite direction when the ratchet release 660 is applied. A rotatable handle extension 610 may preferably be gripped by a user or law enforcement official as the handle is rotated, although such handle extension 610 is not a necessity for the effective operation of the device of the invention. The vertical distance between the halves of the outer casing 400 and spool member 500 is somewhat exaggerated in FIG. 2 to illustrate the constituent elements of the device of the present invention. It will be understood, however, that such distance need only be dimensioned to accommodate the cords 200 and 250 in the wound position along the shaft 500, and should also be great enough to allow for easy and effective reeling and unreeling of the cords along such shaft.

A ratchet mechanism is preferred especially during a strenuous takedown when the resisting arrestee is exerting a maximum amount of force to counter the joining of his or her wrists. Each rotation of the handle 600 and revolution of the spool member 500 results in an effective shortening of the cable members 200 and 250 outside the housing assembly 300, which results in the joining of the handcuffs 100 and 150 with a resultant joinder of the arrestee's wrists. The ratchet mechanism allows the user's handle rotation to have a permanent effect, with each joining stroke not to be defeated or reversed by the separating force exerted by the resisting arrestee. Without the ratchet mechanism, the law enforcement official would have to fight to rotate the handle member 600 and would also have to fight to maintain each successive rotation of the spool member 500. While the ratchet mechanism is obviously preferred, the apparatus of the present invention may be operable without such mechanism, although the efficiency of the device would surely be compromised.

Figure 2A:
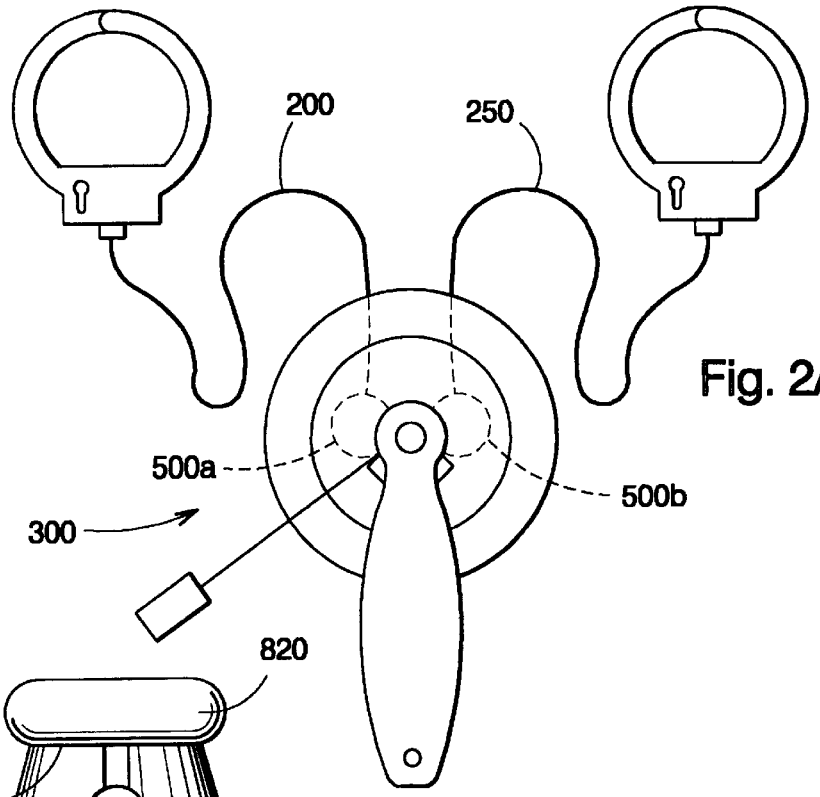
FIG. 2A is a top view of an alternative embodiment of the restraining device of the present invention.

FIG. 2A is a top view of an alternative embodiment of the device of the present invention showing two separate inner spools 500*a* and 500*b* shown in phantom, one for each cable 200 and 250 respectively, as an alternative to a single spool 500 as shown and described in connection with FIGS. 1–2. Such spools 500*a* and 500*b* are preferably gear connected to the ratchet mechanism, so each spool would rotate in a direction opposite the other as the cables are being reeled out or reeled into the housing 300, although other means of interengaging the inner spools with the handle and/or the housing are devisable. One skilled in the art will recognize that a variety of housing assembly embodiments may be used. For example, if a pair of spool members 500*a* and 500*b* as shown in FIG. 2A are implemented in the device of the present invention, such spool members could operate either jointly or independently from each other. If a pair of spool members operated or rotated independently of each other, each spool might have an associated release mechanism, so that each spool member could be reeled and unreeled independently of the other, which would allow a law enforcement official to focus on each individual appendage at a time. Furthermore, it might be useful to allow a detainee to extend only a single appendage, such as, for example, to grab a smoke or the like, while the other appendage would remain secured by the official. In addition, in an embodiment of the invention with multiple inner spools as shown, for example, in FIG. 2A, it might be useful to have multiple handles operating such spools, where separate handles might be used to operate individual cables or the like. Consequently, it will be understood that the housing assembly 300 and its constituent spool members 500 may assume a variety of different operable configurations within the scope of the present invention, with each different configuration designed to achieve a particular handcuffing need.

Figure 4:
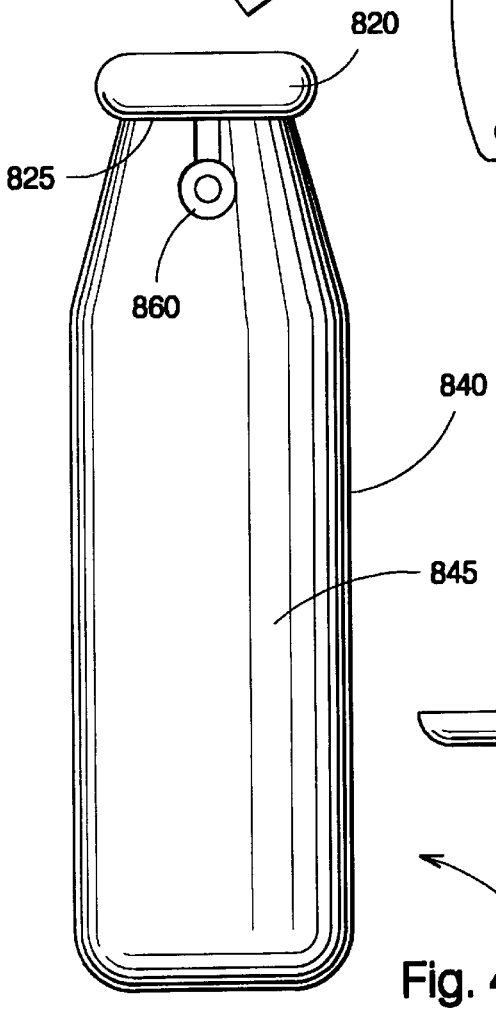
FIG. 4 is a top view of the anchoring implement of FIG. 3.
Figure 3:
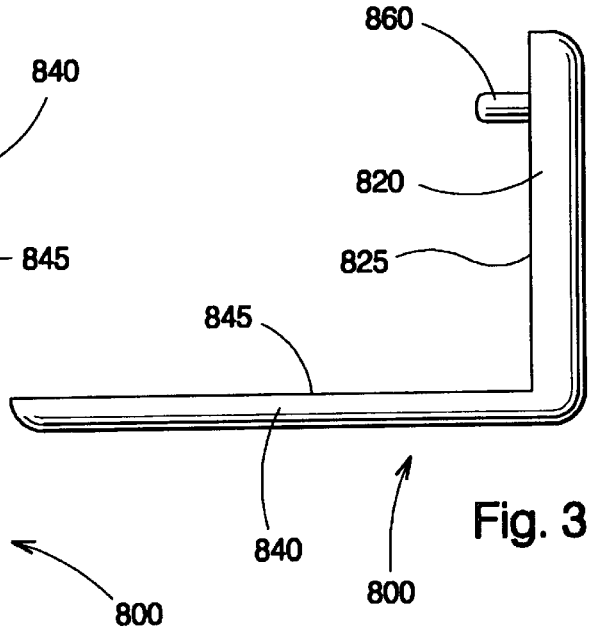
FIG. 3 is a side view of an anchoring implement used in connection with the device of the invention.
Figures 5, 6:
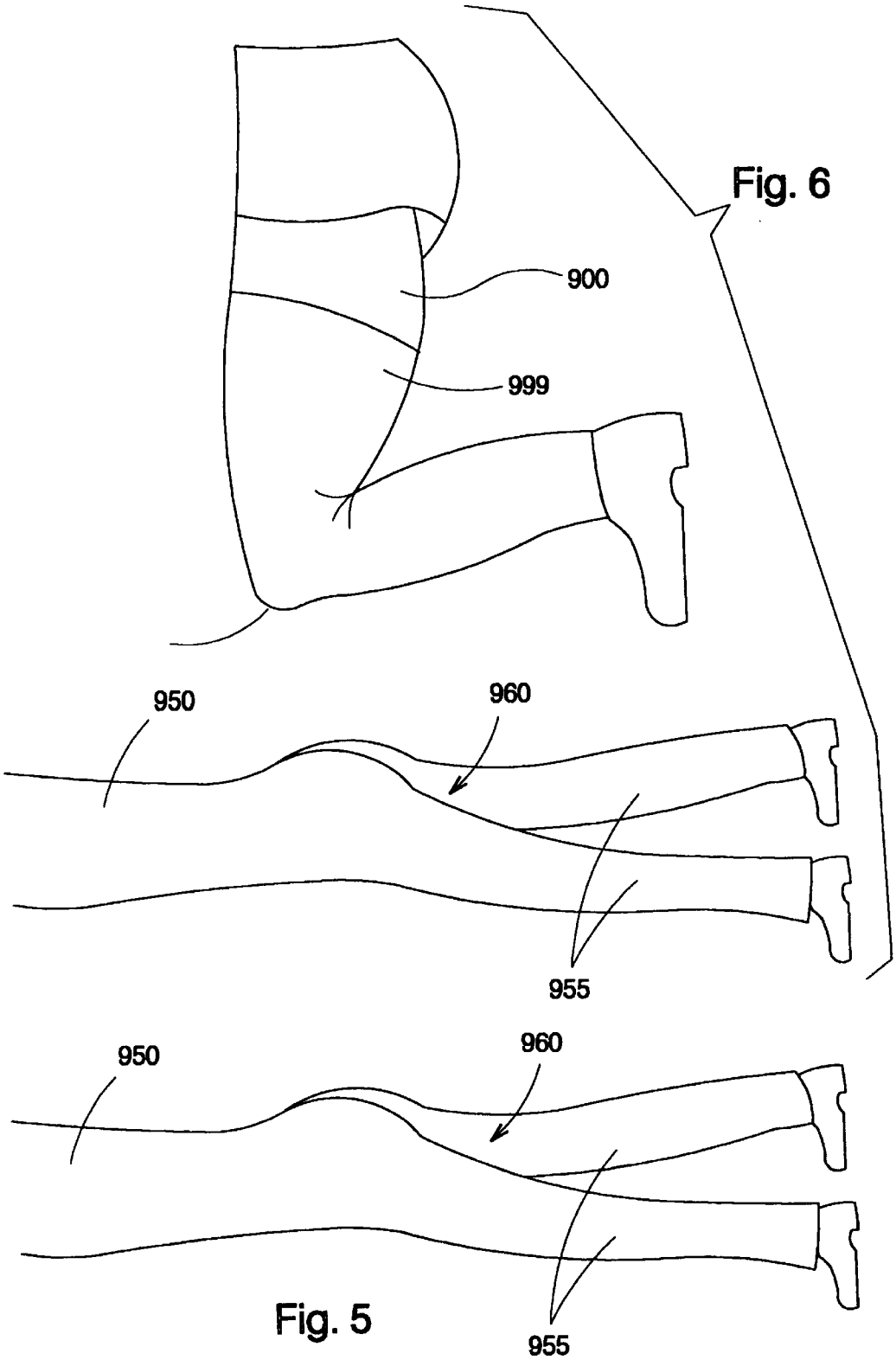
FIG. 5 is a diagrammatic view of a detainee in a prone position for purposes of illustrating the application of the anchoring implement of FIGS. 3 and 4.
FIG. 6 is a diagrammatic view of a detainee in a prone position for purposes of illustrating an alternative embodiment of an anchoring implement used in connection with the device of the present invention.

FIG. 3 is a side view and FIG. 4 is top view of an anchoring implement 800 used when a resisting arrestee 950, the lower half of which is shown, for example, in FIGS. 5 and 6, is in the prone position, or lying stomach down. The anchoring implement comprises a gripping section 820, a leveraging section 840 and a connection member 860 designed to cooperate with attachment means 750 shown in FIGS. 1 and 2 for attachment of the housing assembly 300 to the anchoring implement 800. The anchoring implement 800 is preferably held or gripped by the user or law enforcement official along the gripping section 820, which has a preferably rounded edge rectangular profile or cross section to accommodate a user's hand, such profile shown more particularly in FIG. 4. While the arrestee 950 is in the prone position, the leveraging section 840 is slid along arrow 960 between the arrestee's legs 955 with the upper surface 845 of the leveraging section 840 contacting the arrestee's crotch (not specifically shown) until the gripping section 820, and more particularly the inner surface 825, also comes in contact with the resisting arrestee's crotch.

The connection member 860 is shown in FIG. 4 as a ring onto which the attachment means 750, shown in FIGS. 1 and 2, would be clipped. The connection member 860 could take the form of another connection device, as long as it cooperates the form of the attachment means 750. In this case, the attachment means 750 would take the form of a spring clip, screw clip or other latching device. Of course, other means for securing the housing assembly 300 to the anchoring implement 800 may be used.

FIG. 6 is a side, diagrammatic view of an alternative anchoring implement in the form of a thigh strap 900 worn on a user's thigh 999. Instead of using the anchoring implement 800 of FIGS. 3 and 4, where such implement 800 would be placed securely underneath the resisting arrestee's crotch and held in the official's hands, to properly position the restraining device of the present invention, the anchoring implement 900 of FIG. 6 could be used when the law enforcement official places his or her knee 998 against the resisting arrestee's crotch in preparation for the application of the restraining device of the present invention. Of course, the arresting official could implement both anchoring devices 800 and 900 at the same time, i.e. by wearing the thigh strap 900 and holding the implement 800, and depending on the particular circumstances surrounding the takedown of the resisting arrestee, relocate the housing device 300 between such implements 800 and/or 900 using attachment means 750 and connecting means 860. Or, alternative locations on the official's body could be used for placement of alternative anchoring implements, such as along the waist, on the arm or the like. The connecting means 860 on either implement 800 or 900 should be identical for efficient and interchangeable cooperation with attachment means 750 on the housing assembly 300.

Figure 7:
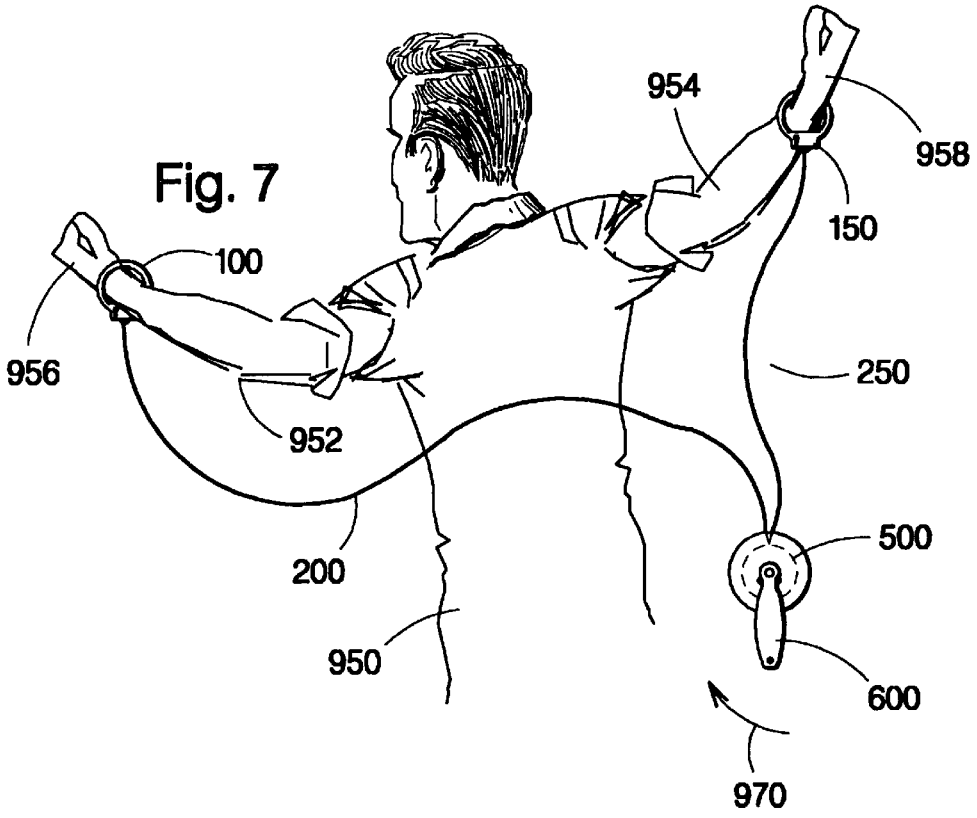
FIGS. 7 and 8 are overall, or top, views of an arrestee in the prone position for purposes of illustrating the use of the device of the present invention.
Figure 8:
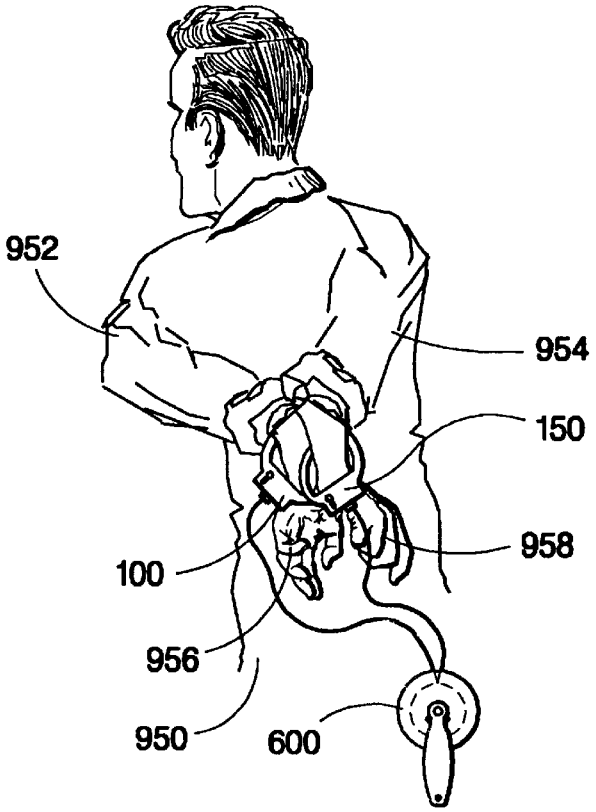

Operation of the device of the present invention is relatively straightforward. FIGS. 7 and 8 are overall, or top, views of an arrestee 950 in the stomach-down position, with arms 952 and 954 separated in FIG. 7 and brought together in FIG. 8. The handcuffs 100 and 150 are initially extended so that cables 200 and 250 are at their fully outstretched position. Using the preferred dimensions described above, handcuffs 100 and 150 would now be capable of separately attaching to a resisting arrestee's wrists that are approximately four feet apart from each other. The law enforcement official (not shown) places one handcuff 100 on one of the arrestee's wrists 956, and then places the other handcuff 150 on the other wrist 958. The official (not shown) then rotates the ratcheting handle 600 in the direction of, for example, of diagrammatic arrow 970, which rotates the spool member 500 and reels in the cables 200 and 250, thereby drawing the handcuffs 100 and 150 and the arrestee's wrists together (see FIG. 8). Of course, if the resisting arrestee is in the prone position, the law enforcement official could use the anchoring implements 800 and 900 shown and described in connection with FIGS. 4 through 6.

After the arrestee's wrists have been joined through successive rotations of the handle 600 (see FIG. 8), the law enforcement official may then maintain the handcuffs 100 and 150 on the arrestee's wrists until a safe location is attained, or take the opportunity to apply conventional handcuffs to the arrestee's already joined wrists and thereafter remove the handcuffs 100 and 150 of the device of the present invention. Of course, once the handcuffs 100 and 150 of the invention are removed from the arrestee's wrists, the law enforcement official merely has to apply the ratchet release 660 to fully extend the cables 200 and 250 and handcuffs 100 and 150 in preparation for another capture.

The apparatus of the present invention may be operated by a single law enforcement official, whereby the anchoring implements would serve as storage devices during the initial capture and takedown of the resisting arrestee. A more efficient operation would occur with two law enforcement officials, where one of the officials could concentrate on stabilizing the arrestee's body while the official armed with the device of the present invention could concentrate on applying the handcuffs to the arrestee's wrists and thereafter reeling them together using the ratchet mechanism described herein. With two or more law enforcement officials, the operation of the device of the invention becomes easier, especially during the handcuffing and rotation of the handle member.

The principal operation of the ratchet mechanism is that in order to efficiently rotate the handle 600 on the housing 400, the housing 400 should be stabilized in some fashion. This can be accomplished in several manners, for example, by the arresting officer holding the housing 400 with one hand while operating the handle 600 with the other. This is practical if there are two arresting officers as the other can then aid in guiding the arrestee's arms into position. In such case, it may be desirable to provide a gripping handle or the like on the housing. However, if there is only one arresting officer, the detainee could then flail about his or her arms while being ratcheted in, with possible injury to himself or herself or the arresting officer. In such case, it is necessary that the housing 400 be at least partially stabilized by being secured to some other object such as the anchors shown in FIGS. 3 through 6, or to the body or preferably an appendage of the arresting officer. The connection is provided by the connecting means 860 and attachment means 750 on the housing, which two means are designed to snap, clip or otherwise secure together, holding the housing tethered to the gripping sections 820 or strap 900. This allows the arresting officer to have one hand free after the restraining devices are applied to aid in controlling the arrestee or in warding off blows or the like.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A restraining device for use by a detainer for attachment to a pair of appendages of a detainee and for forcefully bringing together such detainee's appendages comprising:

a. a housing assembly graspable by the detainer and containing a rotatable spool member, b. a first clasping member unlockable with a key and dimensioned for attachment to a first human appendage and a second clasping member unlockable with a key and dimensioned for attachment to a second human appendage, c. flexible coupling members for reelably coupling each clasping member to the spool member, and d. means to rotate the spool member to reel the coupling members into the spool member and to bring the first and second clasping members closer together and toward the housing assembly.

2. A restraining device in accordance with claim 1 additionally comprising means allowing the spool member to rotate to allow spacing of the clasping members relatively further from each other and the spool member.

3. A restraining device in accordance with claim 2 wherein the means to rotate the spool member includes ratchet means for ratcheting rotation of the spool member.

4. A restraining device in accordance with claim 3 wherein the ratchet means further comprises a handle member and a release member for releasing the ratchet means and enabling the extension of the coupling members from the spool member.

5. A restraining device in accordance with claim 2 wherein the housing assembly further comprises attachment means for removably attaching the restraining device to an anchoring member pre-positionable by the detainer.

6. A restraining device in accordance with claim 5 wherein the anchoring member comprises a strap member adapted to be secured about an appendage of the detainer.

7. A restraining device in accordance with claim 5 wherein the anchoring member comprises a hand-held planar member positionable adjacent the detained to allow the detainer to support the housing assembly of the restraining device with one hand and operate the rotating means with the other hand.

8. A restraining device in accordance with claim 2 wherein the flexible coupling members comprise metal cables.

9. A restraining device in accordance with claim 8 wherein each coupling members is approximately two feet long and approximately one-eighth inch in diameter.

10. A restraining device for use by a detainer for attachment to a pair of appendages of a detainee and for the secured joinder of such appendages in a detained position comprising:

a. a housing assembly capable of being held by a detainer, b. first and second clasping members each capable of being unlocked with a key and dimensioned for individual securement about a pair of human appendages where such human appendages are separated from each other at a distance greater than the distance such human appendages would be if positioned near each other in a detained position, c. flexible coupling members for coupling each clasping member to the housing assembly, and d. means to draw the first and second clasping members together so that the detainee's appendages are forcefully joined toward each other in a detained position.

11. A restraining device in accordance with claim 10 wherein the means to draw the first and second clasping members together further comprises a ratchet reeling mechanism for controlled reeling of the flexible coupling members into the housing assembly.

12. A restraining device in accordance with claim 11 wherein the housing assembly further comprises means to couple the restraining device to a location adjacent the detainer's body.

13. A restraining device in accordance with claim 12 wherein the first and second clasping members are individually securable about a pair of human appendages that are separated from each other by a distance greater than twelve inches.

14. A method of using a restraining device on a detainee, such device having a plurality of handcuffs flexibly coupled by extended flexible coupling means to reel means within a housing assembly comprising:

a. applying a first handcuff to a first human appendage of the detainee, b. applying a second handcuff to a second human appendage of the detainee, and c. rotating the reel means to reel the first and second restraints into the housing assembly to bring together the first and second human appendages of the detainee in a close relationship.

15. A method in accordance with claim 14 wherein the reeling in of the first and second restraints is accomplished by rotating a spool situated within the housing assembly upon which the flexible coupling means are reelable.

16. A method in accordance with claim 15 wherein the rotation is ratchet controlled such that the reeling in of the first and second restraints is unidirectional.

17. A method in accordance with claim 16 further comprising anchoring the restraining device to a position adjacent the body of the user of the device to facilitate the application of the first and second restraints onto the appendages of the detainee and the reeling in of such restraints into the housing assembly.

* * * * *